US010183733B2

(12) United States Patent
Kishimoto et al.

(10) Patent No.: US 10,183,733 B2
(45) Date of Patent: Jan. 22, 2019

(54) PROGRAM, METHOD AND DEVICE FOR CONTROLLING MOVABLE BODY

(71) Applicant: FURUNO ELECTRIC CO., LTD., Nishinomiya (JP)

(72) Inventors: Kazuya Kishimoto, Nishinomiya (JP); Hitoshi Maeno, Nishinomiya (JP); Masashi Imasaka, Nishinomiya (JP)

(73) Assignee: FURUNO ELECTRIC CO., LTD., Nishinomiya (JP)

( * ) Notice: Subject to any disclaimer, the term of this patent is extended or adjusted under 35 U.S.C. 154(b) by 0 days.

(21) Appl. No.: 15/538,602

(22) PCT Filed: Nov. 26, 2015

(86) PCT No.: PCT/JP2015/083151
§ 371 (c)(1),
(2) Date: Jun. 21, 2017

(87) PCT Pub. No.: WO2016/104030
PCT Pub. Date: Jun. 30, 2016

(65) Prior Publication Data

US 2018/0015994 A1 Jan. 18, 2018

(30) Foreign Application Priority Data

Dec. 22, 2014 (JP) ..... 2014-258201

(51) Int. Cl.
*B63H 25/46* (2006.01)
*B63H 25/04* (2006.01)
(Continued)

(52) U.S. Cl.
CPC ..... *B63H 25/46* (2013.01); *B63H 25/04* (2013.01); *B63H 25/06* (2013.01); *B63H 25/38* (2013.01);
(Continued)

(58) Field of Classification Search
CPC ..... B63H 25/46; B63H 25/38; B63H 25/04
See application file for complete search history.

(56) References Cited

U.S. PATENT DOCUMENTS 5,386,368 A 1/1995 Knight
2014/0261126 A1* 9/2014 Jenkins ..... B63B 9/02 114/39.23

FOREIGN PATENT DOCUMENTS

JP 2002-087389 A 3/2002
JP 2012-236584 A 12/2012
(Continued)

OTHER PUBLICATIONS

International Search Report dated Feb. 23, 2016 in PCT Application No. PCT/JP2015/083151, 4 pgs.

*Primary Examiner* — Stephen P Avila
(74) *Attorney, Agent, or Firm* — Knobbe, Martens, Olson & Bear, LLP

(57) ABSTRACT

The purpose is to provide a program, method and device for controlling a movable body (e.g., single-propeller single-rudder ship) to move the movable body while keeping it orientated in a given direction. A controlling module may cause the movable body to stay at a fixed point position by controlling a thrust generator and a moving direction adjustor to orient the movable body to a direction of a disturbance estimated by a disturbance direction estimating module so that the movable body is not drifted by the disturbance. Every time the changing module sequentially changes the fixed point position, the controlling module may move the movable body to the changed fixed point position. Thus, the control device of the movable body of this disclosure may sequentially move the movable body while keeping it oriented to the direction of the disturbance.

19 Claims, 13 Drawing Sheets

(51) Int. Cl.

| | |
|---|---|
| ***B63H 25/42*** | (2006.01) |
| ***B63H 25/38*** | (2006.01) |
| ***B63H 25/06*** | (2006.01) |

(52) U.S. Cl.
CPC ..... *B63H 25/42* (2013.01); *B63H 2025/045* (2013.01); *B63H 2025/465* (2013.01)

(56) References Cited

FOREIGN PATENT DOCUMENTS

| | | | |
|---|---|---|---|
| JP | 2013-151241 | A | 8/2013 |
| JP | 2014-024421 | A | 2/2014 |
| WO | WO 2014-148168 | A1 | 9/2014 |
| WO | WO 2014-065147 | A1 | 9/2016 |

* cited by examiner (A)

(B)

PROGRAM, METHOD AND DEVICE FOR CONTROLLING MOVABLE BODY

TECHNICAL FIELD

This disclosure relates to a program, method and device for controlling a movable body to move the movable body.

BACKGROUND ART

Conventionally, in order to improve the efficiency of fishing, fishermen fish at a location (e.g., a fish reef or a shallow) where many target fish are considered to inhabit. The fishermen operate a ship so that a heading opposes to the direction of wind, so as to confirm whether the target fish exist at the location (so-called drift fishing).

In order to carry out the drift fishing, the ship needs to be attached with a spanker for orienting a bow in the direction of wind (see Patent Document 1.) or a side thruster for moving in a desired direction (e.g., in a starboard/port direction of a ship) (see Patent Document 2.).

REFERENCE DOCUMENTS OF CONVENTIONAL ART

Patent Documents

Patent Document 1: JP2012-236584A
Patent Document 2: JP2002-087389A

DESCRIPTION OF THE DISCLOSURE

Problems to be Solved by the Disclosure

However, single-propeller single-rudder ships having one rudder and only one propeller for thrust cannot move in a direction orthogonal to a fore and aft direction of the ship.

The spanker and thruster as described above are significantly large scaled, also high in cost, and not suitable for the single-propeller single-rudder ships (fishing ships or small ships) which are focusing on economy.

Therefore, this disclosure is to provide a program, method and device for controlling a movable body to move the movable body while keeping it orientated in a given direction.

SUMMARY OF THE DISCLOSURE

According to one aspect of this disclosure, a control device of a movable body including a thrust generator configured to thrust the movable body in a specific direction, and a moving direction adjustor configured to adjust a direction in which the movable body moves by the thrust, may be provided. The control device may include a disturbance direction estimating module configured to estimate a direction of a disturbance that moves the movable body, a movable body direction detector configured to detect an oriented direction of the movable body, a position detecting module configured to detect a position of the movable body, a position setting module configured to set a fixed point position that is a position at which the movable body is to stay, a controlling module configured to control the thrust generator and the moving direction adjustor so that the oriented direction of the movable body detected by the movable body direction detector opposes to the direction of the disturbance estimated by the disturbance direction estimating module, and so that the movable body stays at the fixed point position set by the position setting module, and a changing module configured to sequentially change the fixed point position.

The controlling module may control the thrust generator and the moving direction adjustor so that the movable body is not drifted by the disturbance and the movable body stays at the fixed point position.

Every time the changing module sequentially changes the fixed point position, the controlling module may move the movable body to the changed fixed point position. Thus, the control device of the movable body of this disclosure may sequentially move the movable body while keeping it oriented to the direction of the disturbance.

The changing module may change the fixed point position when a distance between the position of the movable body detected by the position detecting module and the fixed point position is shorter than a first given distance.

The control device of the movable body may change the fixed point position when the movable body reaches at the first given distance from the fixed point position, thus, the movable body may be moved continuously.

Further, the control device of the movable body may include a velocity detector configured to detect a velocity at which the movable body moves. The changing module may change the fixed point position when the velocity detected by the velocity detector is lower than a given velocity.

The control device of the movable body may perform the control to cause the movable body to stay at the fixed point position. Thus, the movable body may decelerate as it approaches the fixed point position. Therefore, when the velocity of the movable body falls below the given velocity, the control device of the movable body may determine that the movable body has approached the fixed point position and change the fixed point position. In this manner, the movable body may move continuously according to the change of the fixed point position.

Moreover, the changing module may change the fixed point position every given period of time.

Further, the changing module may accept an input of a target path along which the movable body is to move, and change the fixed point position on the inputted target path.

The control device of the movable body may change the fixed point position along the accepted target path, thus, the movable body may be moved along the target path.

Further, the disturbance may be a wind or a tidal current that move the movable body. The controlling module may control the thrust generator and the moving direction adjustor so that the oriented direction of the movable body detected by the movable body direction detector opposes to a direction of the wind.

For example, the control device of the movable body may orient the movable body to oppose to the direction of the wind even if the movable body does not have a spanker.

The controlling module may control the thrust generator and the moving direction adjustor so that the oriented direction of the movable body detected by the movable body direction detector opposes to a direction of the tidal current.

The controlling module may accept an input of a target object that is a target of the movement of the movable body, and control the oriented direction of the movable body detected by the movable body direction sensor according to an orientation of the inputted target object.

The controlling module may control the oriented direction of the movable body according to the orientation of the target object (e.g., quay pier, wharf, dock, i.e., any "arriving point").

The controlling module may control the oriented direction of the movable body to be a direction in which the target object is located.

The changing module may change the fixed point position to be located in a direction orthogonal to the direction in which the target object is located, and to have a second given distance from the target object.

For example, the fixed point position may be changed to a position orthogonal to the orientation of the quay and separated, for example, by 10 m from the quay. Thus, the control device of the movable body may move the movable body parallel to the orientation of the quay while keeping the movable body oriented in the direction orthogonal to the direction of the quay.

Further, the controlling module may control the oriented direction of the movable body to be orthogonal to a direction in which the target object is located.

The changing module may change the fixed point position to be located in the direction in which the target object is located, and to have a third given distance from the target object.

For example, the fixed point position may be changed to a position in a direction in which the pier exists and separated, for example, by 2 m from the pier. Thus, the control device of the movable body may move the movable body to the fixed point position close to the pier while keeping the movable body oriented to the direction in which the pier exists.

Further, when a deviation angle between the oriented direction of the movable body detected by the movable body direction detector and the direction of the disturbance estimated by the disturbance direction estimating module becomes equal to or larger than a given angle, the controlling module may only control the oriented direction of the movable body to oppose to the direction of the disturbance.

For example, when an oriented direction of a movable body greatly offsets from a direction of disturbance due to a change in the disturbance etc., a general single-propeller single-rudder ship may need to turn the rudder significantly so as to move to the fixed point position, and thus move on an unnecessary path. For this reason, the controlling module may suspend the control to stay at (move to) the fixed point position, and may only control the oriented direction of the movable body to oppose to the direction of the disturbance. As a result, the control device of the movable body may prevent the movable body from moving on the unnecessary path.

This disclosure may not be limited to the device and be applied to a method of controlling a movable body or a control device movable body program executed by the control device of the movable body.

Effects of the Disclosure

According to this disclosure, the movable body may be moved along the sequentially changed fixed point position while keeping the movable body orientated in the given direction without any additional equipment which is movable in a starboard/port direction.

MODE FOR CARRYING OUT THE DISCLOSURE

Figure 1:
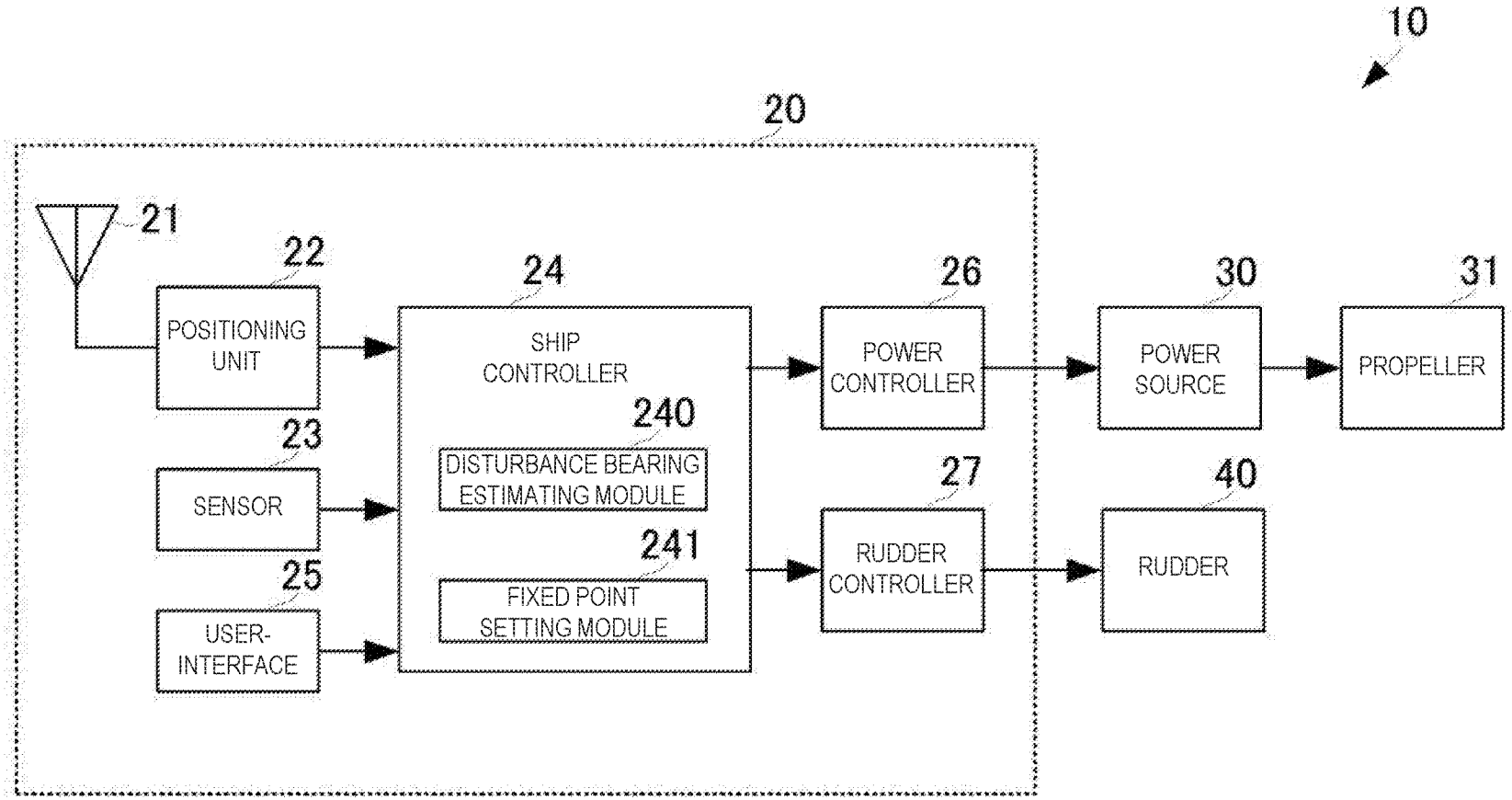
FIG. 1 is a block diagram illustrating a main configuration of a ship according to one embodiment.

A ship including a ship control device and a method of controlling a ship according to one embodiment of this disclosure are described with reference to the accompanying drawings. FIG. 1 is a block diagram illustrating a main configuration of the ship 10 according to the embodiment of this disclosure.

The ship 10 may include a ship control device 20, a power source 30, a propeller 31, and a rudder 40. The ship control device 20 may include an antenna 21, a positioning unit 22, a sensor 23, a ship controller 24, a user-interface 25, a power controller 26, and a rudder controller 27.

The ship controller 24 may include a disturbance bearing estimating module 240 and a fixed point setting module 241.

The positioning unit 22 may correspond to "position detecting module" of this disclosure. The ship controller 24 may correspond to "position setting module," "controlling module," and "changing module" of this disclosure. The pair of the power source 30 and the propeller 31 may correspond to "thrust generator." Further, the rudder 40 may correspond to "moving direction adjustor."

The ship 10 may be a single-propeller single-rudder ship having one rudder (rudder 40) and only movable forward or backward.

The antenna 21 may receive GPS (; Global Positioning System) positioning signals and output them to the positioning unit 22. The positioning unit 22 may calculate a position of the ship 10 by executing a positioning calculation using the GPS positioning signals. This positioning calculation may be executed at every preset positioning timing. The positioning unit 22 may output the calculated position of the ship 10 to the ship controller 24.

For example, the sensor 23 may be comprised of necessary one or more of a heading sensor for detecting a heading (corresponding to the movable body direction detector of this disclosure), a velocity sensor for detecting a ship velocity, a wind direction sensor, a wind speed sensor, a tidal current meter, etc. Note that the sensor 23 may output the detected heading, velocity, wind direction, wind speed, and tidal current to the ship controller 24 as needed. Note that the sensor 23 may be attached as needed, and not an essential structure of this disclosure. For example, when the sensor 23 is not provided with the heading sensor or the velocity sensor, the ship controller 24 may estimate the heading or the velocity of the ship 10 based on a change in a current position.

The user-interface 25 may be a so-called user interface device, and may receive an operational input from a user and output it to the ship controller 24.

The fixed point setting module 241 may set a fixed point inputted from the user via the user-interface 25.

The disturbance bearing estimating module 240 may estimate a bearing at which a disturbance that moves the ship 10 exists. The disturbance may mainly be comprised of a tidal current and wind.

The ship controller 24 may set control information for controlling the ship 10 to stay at a position of the fixed point. The control information may, for example, be comprised of information of a power amount and information of a thrust direction. The information of the power amount may be outputted to the power controller 26. The information of the thrust direction may be outputted to the rudder controller 27.

The power controller 26 may control the power source 30 to drive based on the information of the power amount.

The power source 30 may be comprised of a diesel engine or a motor. The power source 30 may supply to the propeller 31 power generated based on the control by the power controller 26. Note that the power source 30 may be a hybrid mechanism including both the diesel engine and the motor.

The rudder controller 27 may adjust a steering angle of the rudder 40 with respect to a fore and aft direction of the ship 10. The rudder controller 27 may adjust the steering angle of the rudder 40 based on information of the thrust direction outputted from the ship controller 24.

The ship 10 may move toward the fixed point position by controlling a thrust of the propeller 31 and the steering angle of the rudder 40.

Next, a control of the ship to move to the fixed point position of this embodiment is described with reference to FIGS. 2 to 4. The ship 10 may estimate a disturbance bearing which is the bearing at which the disturbance that moves the ship 10 exists, control the power amount and the thrust direction based on the estimated disturbance bearing, and move to the fixed point position.

First, the estimation of the disturbance bearing is described. FIG. 2 is a view illustrating the estimation of the disturbance bearing.

The fixed point setting module 241 may determine and set the fixed point position specified by the user via the user-interface 25 as the fixed point position Pp.

The disturbance bearing estimating module 240 may estimate the disturbance bearing. The disturbance bearing as an initial value may be any bearing, for example, a direct south direction. The ship controller 24 may control the thrust direction so that the heading opposes to the estimated disturbance bearing.

Figure 2:
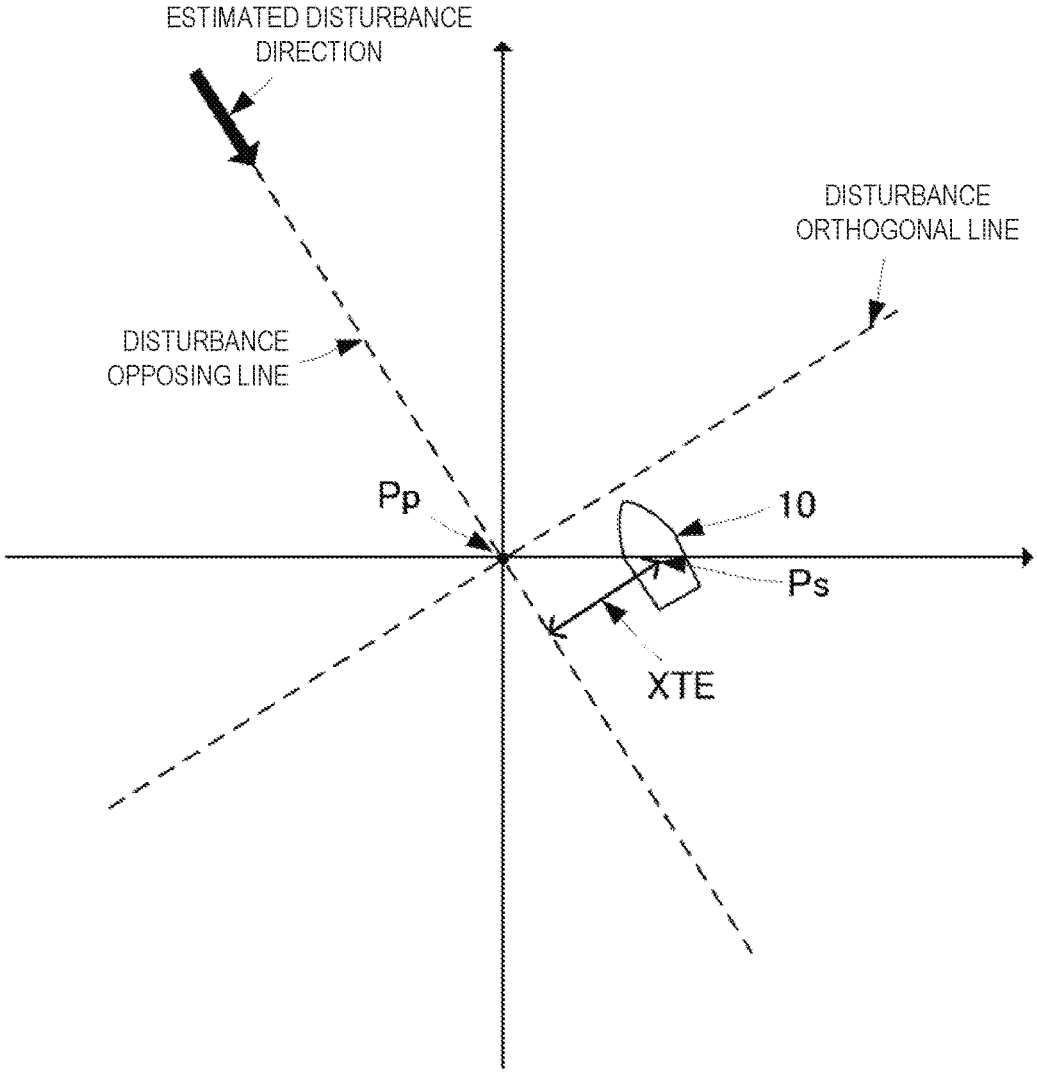
FIG. 2 is a view illustrating an estimation of a bearing of a disturbance.

Next, as illustrated in FIG. 2, the disturbance bearing estimating module 240 may obtain a distance XTE (; Cross Track Error) between a disturbance opposing line passing through the fixed point position Pp and parallel to the estimated disturbance bearing, and a current position Ps.

The distance XTE may become 0 when the estimated disturbance bearing agrees with the heading and the ship 10 moves to the fixed point position Pp.

Further, the disturbance bearing estimating module 240 may obtain the distance XTE at every given period of time, and calculate a new disturbance bearing by obtaining a difference between the estimated disturbance bearing and a correction value based on the distance XTE, as indicated by the following equation 1.

$$\hat{\psi}_d = \psi_0 - \left\{k_p \cdot XTE + \sum\left(k_{i1} \cdot XTE + k_{i2} \cdot \frac{d}{dt}XTE\right)\right\} \quad (1)$$

$\hat{\psi}_d$: Estimated disturbance bearing $\psi_0$: Initial value of estimated disturbance bearing $k_p$: Proportional correction gain $k_{i1}$: First integral correction gain $k_{i2}$: Second integral correction gain That is, the disturbance bearing estimating module 240 may update the estimated disturbance bearing so that the distance XTE becomes 0, based on a proportional component of the distance XTE (the term of the proportional correction gain of Equation 1) and an integral component of the distance XTE (the term of Σ of Equation 1).

By including a differential term of the distance XTE (the term of the second integral correction gain of Equation 1) in the integral component of the distance XTE (the term of Σ of Equation 1), the disturbance bearing estimating module 240 can speed up the convergence (the distance XTE becoming 0) and cause the estimated disturbance bearing to smoothly approach the actual disturbance bearing until the convergence.

Note that, the estimation of the disturbance bearing based on Equation 1 is not essential, and the disturbance bearing may be obtained by another method.

Next, the control of the power amount and the thrust direction after the disturbance bearing is estimated is described with reference to FIGS. 3 and 4.

Figure 3:
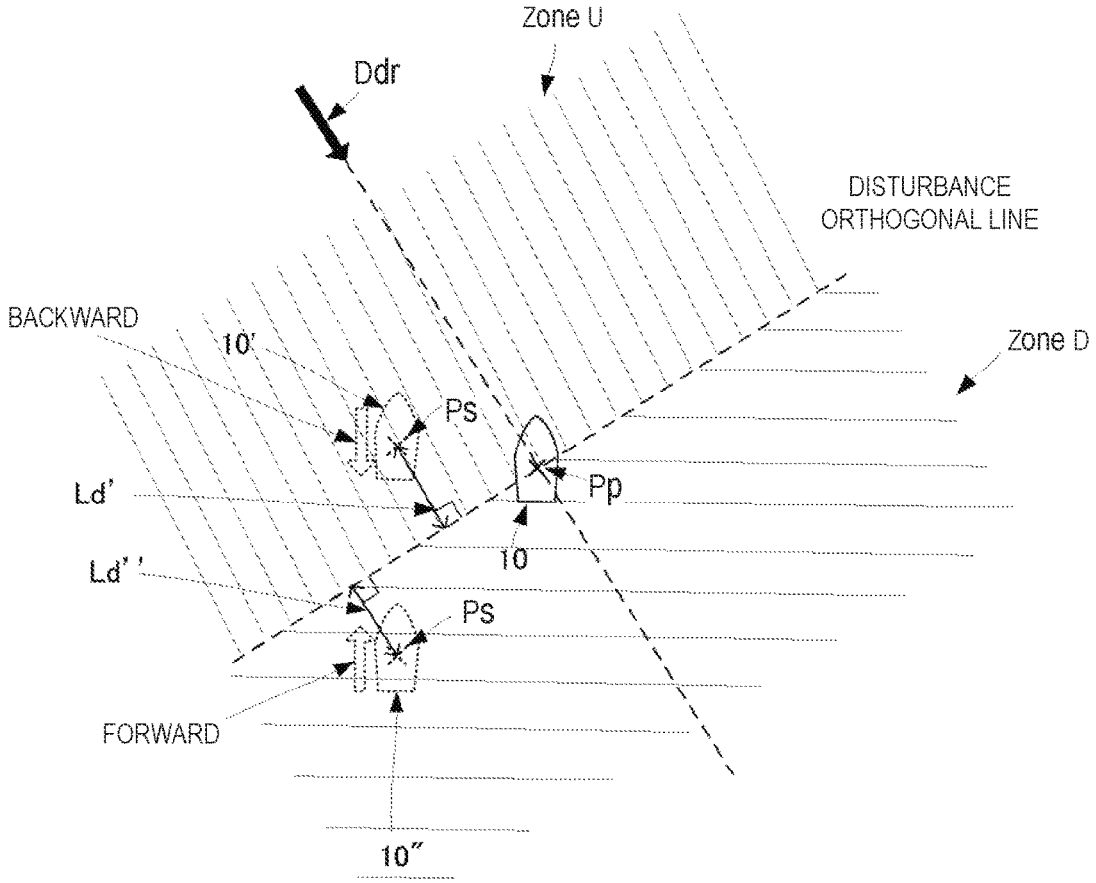
FIG. 3 is a view illustrating a control of a power amount.

FIG. 3 is a view illustrating one example in which the ship 10 controls the power amount and stays at the fixed point position Pp in a situation subjected to the disturbance. In FIG. 3, a disturbance vector Ddr may be a velocity vector comprised of a bearing and magnitude of the disturbance. ZoneU may be an area on a disturbance upstream side from a disturbance orthogonal line passing through the fixed point position Pp and orthogonal to the disturbance bearing. ZoneD may be an area on a disturbance downstream side from the disturbance orthogonal line. A ship 10' may indicate the ship 10 when located in the ZoneU. A ship 10" may indicate the ship 10 when located in the ZoneD.

When the disturbance bearing estimating module 240 estimates the bearing of the disturbance vector Ddr, the ship controller 24 may control the power amount for a forward or backward movement based on the bearing of the disturbance vector Ddr, the heading, and the fixed point position.

In the description of this embodiment, when an angle formed by the heading and the bearing of the disturbance vector Ddr with respect to a gravity center of the ship is within an angle range of −90° to +90°, this may be referred to as "the heading opposes to the bearing of the disturbance vector Ddr." When the angle formed by the heading and the bearing of the disturbance vector Ddr is outside the angle range of −90° to +90°, this may be referred to as "the heading does not oppose to the bearing of the disturbance vector Ddr. Note that, in FIG. 3, when the heading is on the clockwise side with reference to the bearing of the disturbance vector Ddr, the angle formed by the heading and the bearing of the disturbance vector Ddr may be defined as a positive (+) angle, and when the heading is on the counterclockwise side with reference to the bearing of the disturbance vector Ddr, the angle formed by the heading and the bearing of the disturbance vector Ddr may be defined as a negative (−) angle.

When the heading of the ship 10' opposes to the bearing of the disturbance vector Ddr and is located in the ZoneU as illustrated in FIG. 3, the ship controller 24 may output the control information of the power amount to move backward. When the heading of the ship 10" opposes to the bearing of the disturbance vector Ddr and is located in the ZoneD as illustrated in FIG. 3, the ship controller 24 may output the control information on the power amount to move forward.

Further, when the heading of the ship 10' does not oppose to the bearing of the disturbance vector Ddr and is located in the ZoneU, the ship controller 24 may output the control information of the power amount to move forward. When the heading of the ship 10" does not oppose to the bearing of the disturbance vector Ddr and is located in the ZoneD, the ship controller 24 may output the control information of the power amount to move backward.

In this manner, the ship 10 may travel between the ZoneU and the ZoneD across the disturbance orthogonal line.

Next, a control to move to the fixed point position is described with reference to FIG. 4. FIG. 4 is a view illustrating one example of controlling the power amount and the thrust direction to move the ship 10 to the fixed point position after estimating the bearing of the disturbance vector Ddr.

Figure 4:
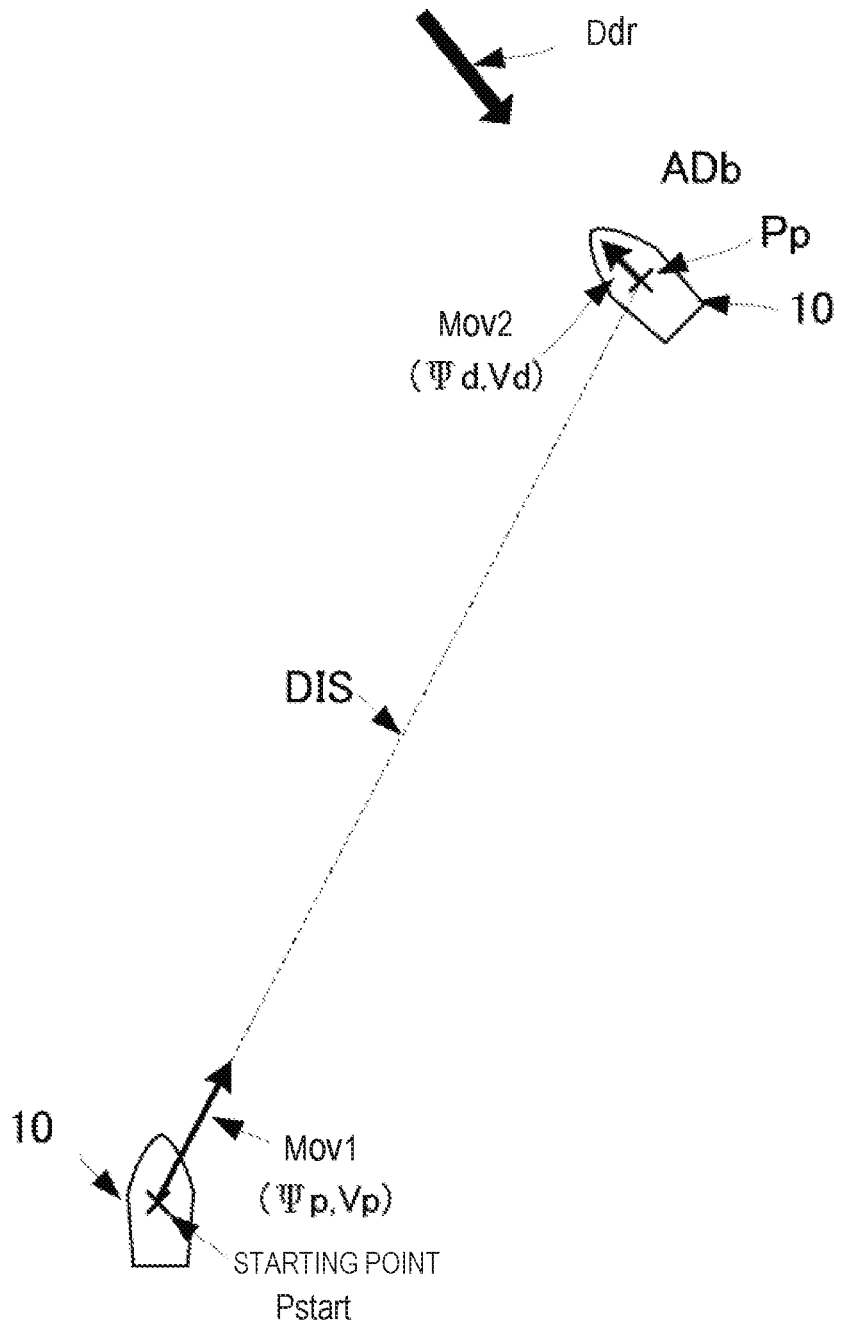
FIG. 4 is a view illustrating one example of traveling to a fixed point position.

In FIG. 4, a velocity vector Mov1 may be a velocity vector comprised of a bearing Ψp and a velocity Vp and for moving from the current position Ps to the fixed point position Pp. A velocity vector Mov2 may be a velocity vector comprised of a bearing Ψd and a velocity Vd and taken with reference to the fixed point position Pp to stay at the fixed point position Pp.

Based on the distance to the fixed point position Pp, the ship controller 24 may change a target bearing and a target velocity to be targets.

First, the ship controller 24 may set the current position Ps obtained by the positioning unit 22 as a position Pstart and set the bearing toward the fixed point position Pp with reference to the position Pstart as the bearing $\Psi_p$. The ship controller 24 may set a highest settable velocity of the ship 10 as the velocity Vp.

Further, the ship controller 24 may set the bearing opposing to the bearing of the estimated disturbance vector Ddr as the bearing Ψd, and set the velocity 0 as the velocity Vd.

Next, as indicated by the following equation, the ship controller 24 may add with a weight, the bearing Ψp and the bearing Ψd to obtain a target bearing Ψx. As indicated by the following equation, the ship controller 24 may add with a weight, the velocity Vp and the velocity Vd to obtain a target velocity Vx.

$$\Psi x=\alpha\Psi p+(1-\alpha)\Psi d$$

$$Vx=\alpha Vp+(1-\alpha)Vd$$

Note that, the coefficient α may be a value larger than 0 and equal or smaller than 1, and obtained based on a distance DIS from the current position Ps to the fixed point position Pp, as indicated by the following equation.

$$\alpha=1-\exp^{-(DIS/DISi)}$$

Note that, the distance DISi may be a distance from the position Pstart to the fixed point position Pp. In other words, the ship controller 24 may increase the coefficient α as the distance DIS is longer, and reduce the coefficient α as the distance DIS is shorter.

That is, when the ship 10 is close to the fixed point position Pp, the ship controller 24 may calculate the target bearing Ψx and the target velocity Vx so as to stay at the fixed point position Pp. Further, when the ship 10 is far from the fixed point position Pp, the ship controller 24 may calculate the target bearing Ψx and the target velocity Vx so as to move toward the fixed point position Pp.

Next, the ship controller 24 may generate the control information of the power amount and the control information of the thrust direction so that the ship 10 navigates at the target bearing Ψx and the target velocity Vx. For example, the ship controller 24 may generate the control information of the thrust direction in which a value obtained by multiplying a deviation angle Ψdiff between the target bearing Ψx and a heading Ψs by a given coefficient k1 is the rudder angle to be taken by the rudder 40. Note that the heading Ψs is acquired by the heading sensor provided to the sensor 23.

The ship controller 24 may output to the power controller 26 a velocity difference Vdiff obtained by subtracting the velocity of the ship 10 from the target velocity Vx, as the control information of the power amount. The power controller 26 may control the power source 30 by having, as the power amount to be given to the power source 30, a value obtained by multiplying the velocity difference Vdiff by a given coefficient k2. Note that, when the velocity difference Vdiff is a negative value (the target velocity Vx is lower than the velocity of the ship 10), the power controller 26 may set the power amount to 0. The velocity of the ship 10 may be obtained by the velocity sensor provided to the sensor 23.

As described above, the ship controller 24 may output the control information of the power amount so that the ship 10 moves toward the disturbance orthogonal line. Here, since the target velocity Vx becomes higher as the ship 10 is farther from the disturbance orthogonal line, there is a possibility that the ship 10 greatly crosses (overshoots) the disturbance orthogonal line.

Therefore, the power controller 26 may set an upper limit value of the power amount (e.g., fuel injection amount). When a power amount F obtained based on the velocity difference Vdiff exceeds the upper limit value Fmax, the power controller 26 may reduce the power amount F to the upper limit value Fmax. Further, the power controller 26 may adjust the upper limit value Fmax of the power amount F and cause the ship 10 to stay in the vicinity of the disturbance orthogonal line.

An adjustment of the upper limit value Fmax of the power amount F is described with reference to FIG. 3. A distance Ld' is a distance from the position of the ship 10' to the disturbance orthogonal line when the ship 10' located in the ZoneU is most distant from the disturbance orthogonal line. A distance Ld" is a distance from the position of the ship 10" to the disturbance orthogonal line when the ship 10" located in the ZoneD is most distant from the disturbance orthogonal line.

The power controller 26 may adjust the upper limit value Fmax of the power amount F based on the distance Ld' or the distance Ld". For example, when the distance Ld' is longer than a given distance Ldth, the power controller 26 may lower the upper limit value Fmax of the power amount F by an adjustment amount ΔF. Next, when the distance Ld" is longer than the given distance Ldth, the power controller 26 may further lower the upper limit value Fmax by the adjustment amount ΔF.

Further, when the distance Ld' is shorter than the given distance Ldth, the power controller 26 may increase the upper limit value Fmax of the power amount by the adjustment amount ΔF. Next, when the distance Ld" is shorter than the given distance Ldth, the power controller 26 may further increase the upper limit value Fmax by the adjustment amount ΔF.

As described above, by reducing the velocity, the ship 10 may prevent a large overshoot, and when the overshoot becomes small, the ship 10 may increase the velocity. The ship 10 may repeat the increase and reduction of the velocity and control the distance of the overshoot.

As described above, the ship 10 may estimate the disturbance bearing and perform an automatic navigation toward the fixed point position so that the heading opposes to the disturbance bearing at the fixed point position, based on the estimated disturbance bearing.

Next, the automatic navigation of the ship 10 according to the change in the position of the fixed point of this embodiment is described with reference to FIG. 5.

Figure 5:
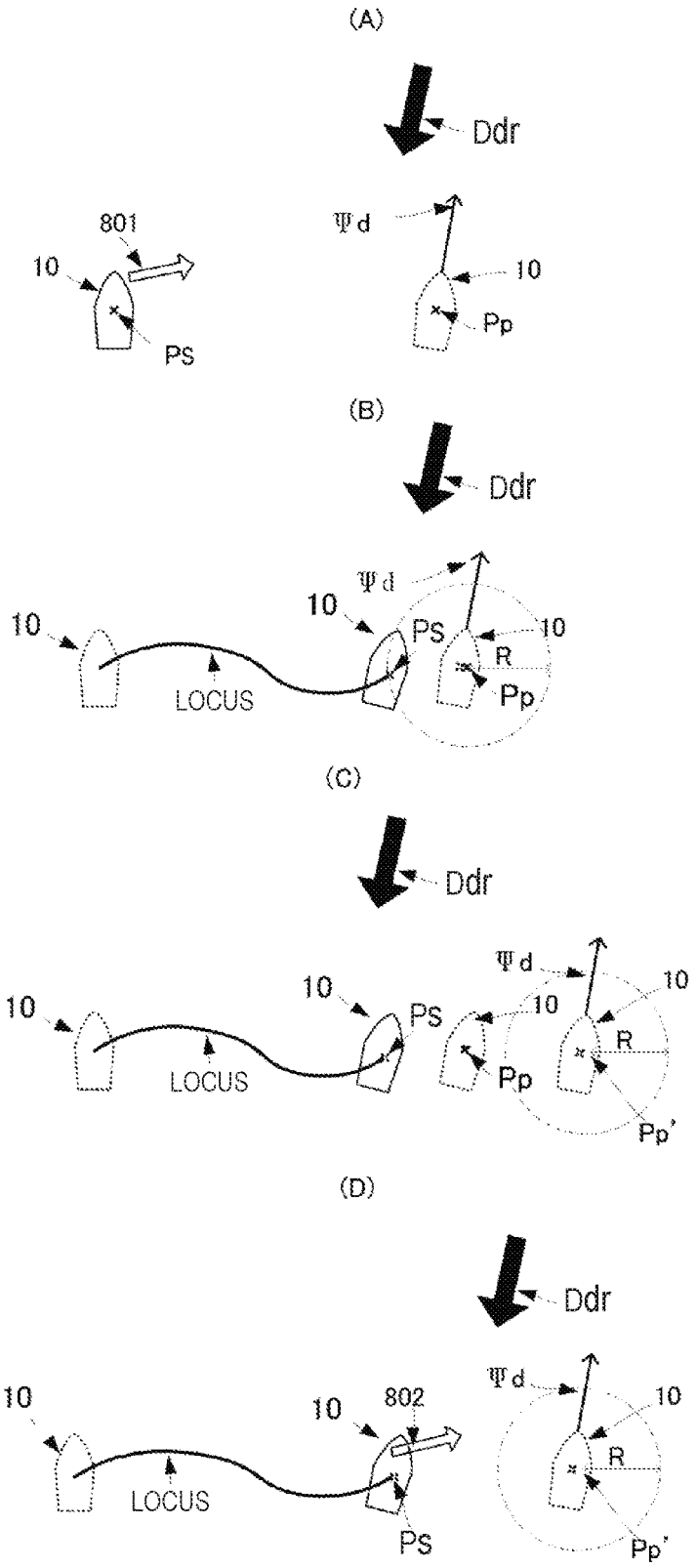
FIG. 5 shows views illustrating one example of changing the fixed point position.

When the fixed point position Pp is set as illustrated in Part (A) of FIG. 5, the ship 10 may move toward the fixed point position Pp as indicated by a thick white-blank arrow 801 while receiving the disturbance.

During the automatic navigation, the ship controller 24 may periodically calculate the distance from the current position Ps of the ship 10 to the fixed point position Pp. When the distance becomes a given distance R (e.g., 10 m) or less as illustrated in Part (B) of FIG. 5, the fixed point position Pp may be changed to a fixed point position Pp' as illustrated in Part (C) of FIG. 5. The fixed point position Pp' may be set manually or automatically by the fixed point setting module 241.

Note that the ship controller 24 may set the heading at the fixed point position Pp' as the bearing Ψd; however, when updating the fixed point position, the ship controller 24 may change the target bearing Ψx.

Then, as illustrated in Part (D) of FIG. 5, the ship controller 24 may move the ship toward the new fixed point position Pp'.

Further, the ship 10 may use the velocity of the ship 10 without using the distance from the current position Ps to the fixed point position Pp as a trigger to newly set the fixed point position. As described above, the ship 10 may perform the control to stay at the fixed point position Pp. Thus, the ship 10 may decelerate as it approaches the fixed point position Pp. Therefore, the ship controller 24 may set the new fixed point position Pp' by using the velocity of the ship 10 falling below a given threshold as a trigger. In this case, the ship controller 24 may periodically obtain the velocity by the velocity sensor provided to the sensor 23. When the velocity is at or below the given threshold continuously for a given period of time, the ship controller 24 may determine that the velocity has reduced due to the approach to the fixed point position Pp, and set the new fixed point position Pp'.

Figure 6:
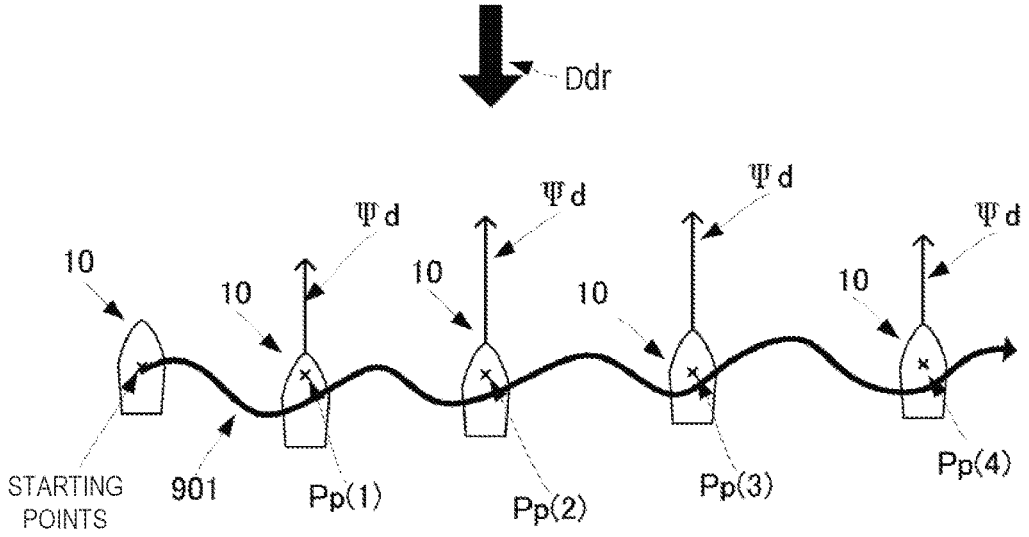
FIG. 6 is a view illustrating one example of sequentially changing the fixed point position.

Next, FIG. 6 is a view illustrating a course when the fixed point position is changed sequentially.

A fixed point position Pp(n) may be the n-th set fixed point position. A course 901 may be a locus of the ship 10.

As illustrated in FIG. 6, when the ship 10 is located at a starting point S, the ship 10 may set a fixed point position Pp(1). When the ship 10 approaches a fixed point position Pp(1), the ship 10 may set a fixed point position Pp(2). Similar to the fixed point position Pp(1) and the fixed point position Pp(2), a fixed point position Pp(3) and a fixed point position Pp(4) may also be set when approaching the fixed point position Pp immediately preceding thereto.

As described above, every time the ship 10 approaches the set fixed point position Pp, the ship 10 may set a new fixed point position Pp' and move toward the new fixed point position. Therefore, the ship 10 can automatically navigate according to the change of the fixed point position Pp while keeping the heading Ψs at the bearing Ψd (opposing to the disturbance bearing).

In the above example, although the new fixed point position Pp' is set using the distance R to the fixed point position Pp or the velocity as a trigger, the fixed point position Pp may be changed every given period of time, or the ship 10 may set the fixed point position Pp as follows.

Figure 7:
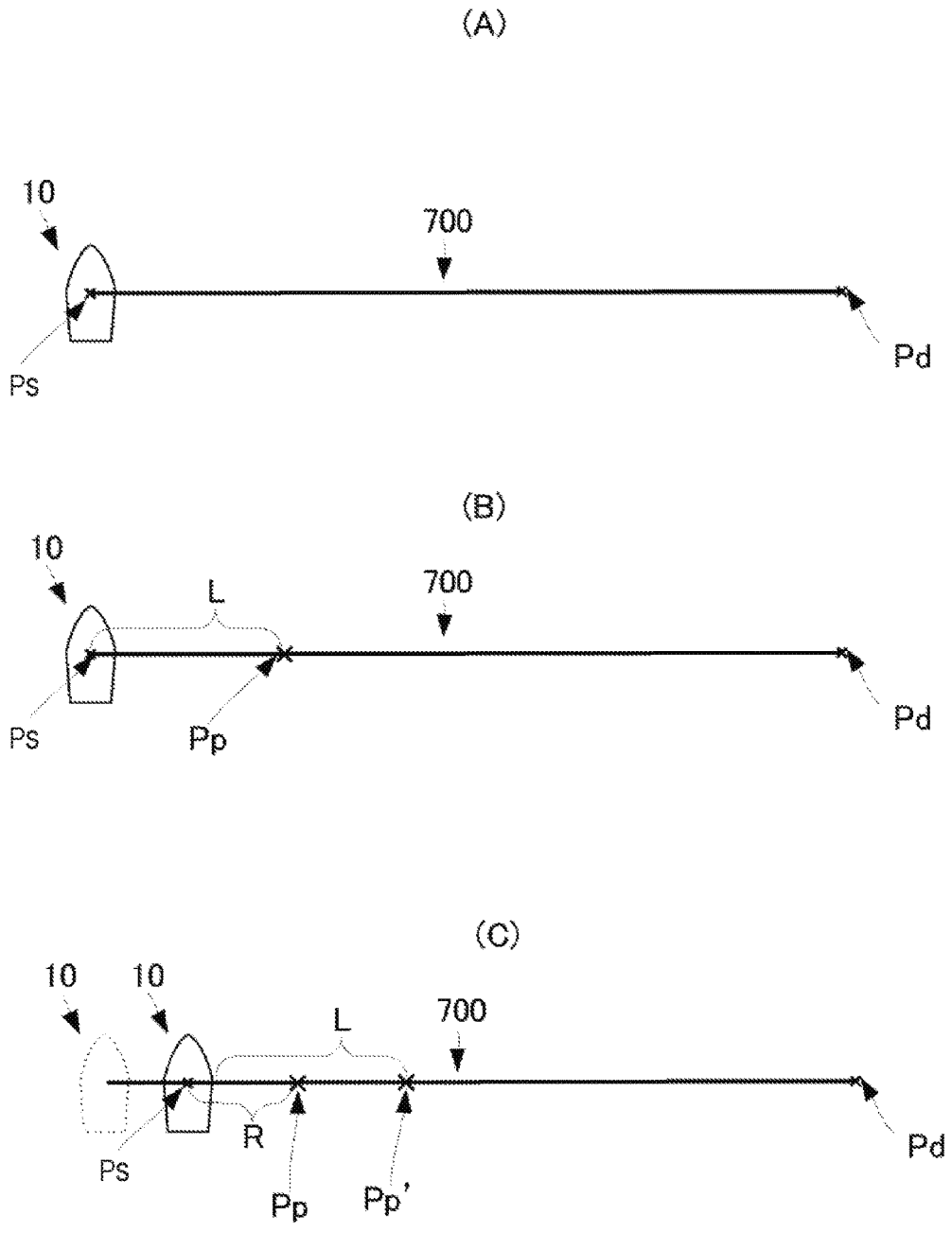
FIG. 7 shows views illustrating another example of sequentially changing the fixed point position.

As illustrated in Part (A) of FIG. 7, the fixed point setting module 241 may set a final destination Pd as a location that the user ultimately wants to reach by the automatic navigation. Next, as illustrated in Part (A) of FIG. 7, the fixed point setting module 241 may set a target straight line 700 extending from the current position Ps of the ship 10 when the final destination point Pd is set, to the final destination Pd. Further, as illustrated in Part (B) of FIG. 7, the fixed point setting module 241 may set a point which is located on the set target straight line 700 and has a given distance L from the current position Ps, to be the fixed point position Pp.

As illustrated in Part (C) of FIG. 7, upon approaching to a given distance R (note that, distance R<distance L) from the fixed point position Pp, the fixed point setting module 241 may set the new fixed point position Pp' at a point located on the target straight line 700 and having the distance L from the current position Ps.

As described above, by automatically setting the fixed point position Pp, the ship 10 can move substantially in a straight line to the final destination Pd.

Note that the new fixed point position Pp' may be set at a point separated by the distance L from the fixed point position Pp, instead of from the current position Ps.

Figure 8:
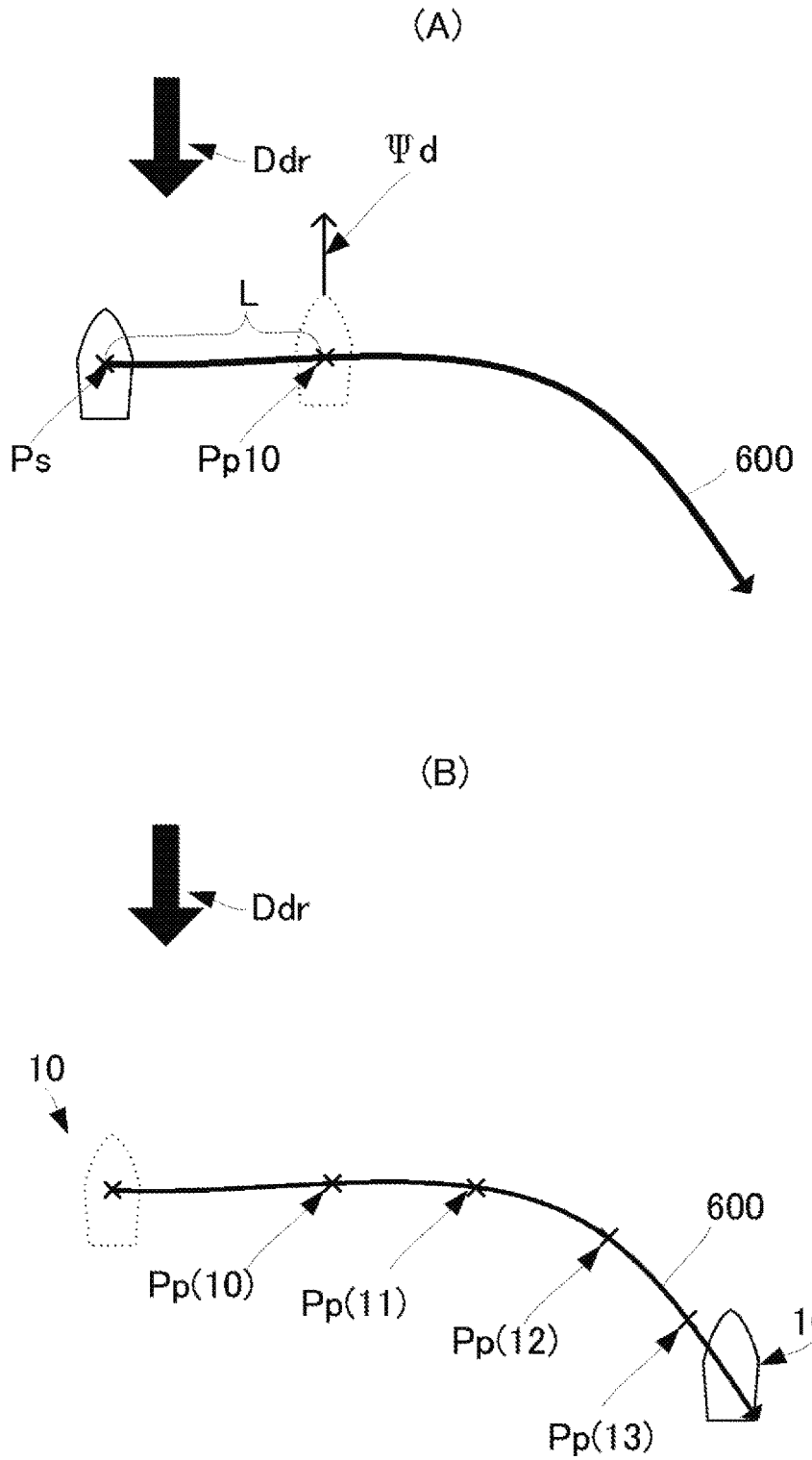
FIG. 8 shows views illustrating another example of sequentially changing the fixed point position.

Further, the fixed point setting module 241 may allow the user to input the course instead of the final destination Pd. FIG. 8 shows views illustrating setting of the fixed point when the user inputs the course.

First, as illustrated in Part (A) of FIG. 8, the user may input a course 600 to the ship controller 24 via the user-interface 25 (e.g., through a touch panel). Then, as illustrated in Part (A) of FIG. 8, the fixed point setting module 241 may set the fixed point position Pp on the course 600 inputted by the user, at a point separated from the current position Ps by the given distance L.

Then, as illustrated in Part (B) of FIG. 8, the ship 10 may automatically navigate along the course 600 by sequentially setting the fixed point position Pp on the course 600 inputted by the user.

Further, the fixed point setting module 241 may store a plurality of automatically navigated courses, display the plurality of stored courses on the user-interface 25 (e.g., a display with a touch panel), and allow the user to select the course to be automatically navigated.

Figure 9:
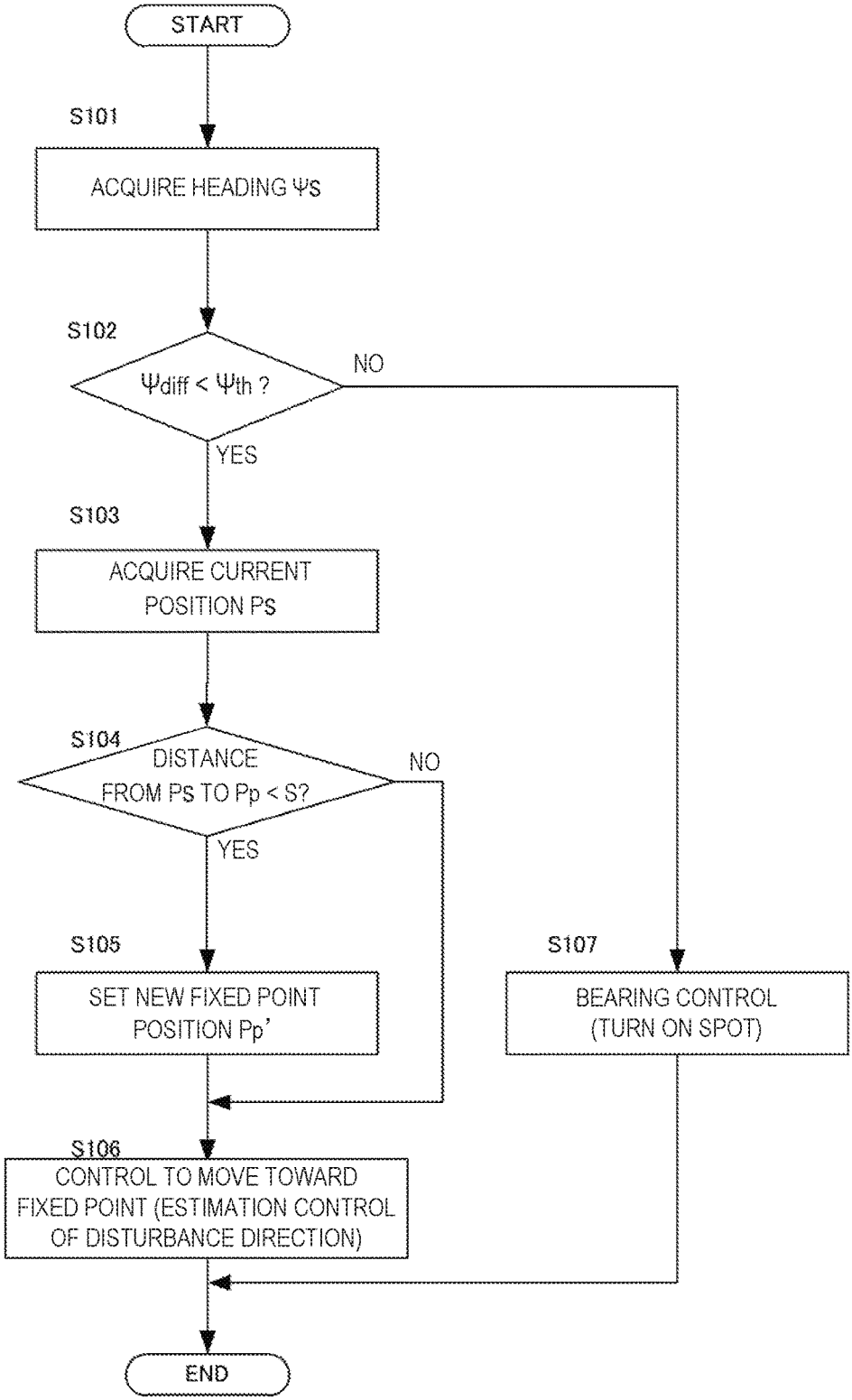
FIG. 9 is a flowchart illustrating operation of the ship according to this embodiment.

Next, FIG. 9 is a flowchart of a movement control during the automatic navigation of the ship 10. As a condition of the control, the fixed point position Pp is considered to have already been set by the user or by the ship controller 24. The target bearing Ψx and the target velocity Vx are also considered to have been obtained according to the current position Ps by setting the fixed point position Pp.

First, during the automatic navigation, the ship controller 24 may acquire the heading Ψs, which is a bearing from the center of the ship toward the bow, by the heading sensor provided to the sensor 23 (S101).

Then, the ship controller 24 may calculate the deviation angle Ψdiff between the heading Ψs and the target bearing Ψx. Then, the ship controller 24 may determine whether the deviation angle Ψdiff is smaller than a given angle Ψth (S102). If the deviation angle Ψdiff is smaller than the angle Ψth (S102: YES), the ship controller 24 may proceed to S103.

If the deviation angle Ψdiff is smaller than the angle Ψth (S102: YES), the ship controller 24 may acquire the current position Ps of the ship 10 (S103).

The ship controller 24 may calculate the distance from the current position Ps to the fixed point position Pp. Then, the ship controller 24 may determine whether the distance is shorter than a given distance S (S104). If the distance is shorter than the distance S (S104: YES), the ship controller 24 may proceed to S105.

If the distance is shorter than the distance S (S104: YES), the fixed point setting module 241 may set the new fixed point position Pp' (S105) and generate the control information to move to the fixed point position Pp' (S106).

If the distance from the current position Ps to the fixed point position Pp is equal to or longer than the given distance S (S104: NO), the ship controller 24 may perform a control to move toward the fixed point position Pp (S106). In other words, the fixed point setting module 241 may not change the fixed point position Pp in this case.

If the deviation angle Ψdiff between the current heading Ψs and the target bearing Ψx is equal to or larger than the angle Ψth (S102: NO), the ship controller 24 may perform a bearing control for adjusting the heading Ψs (S107).

Figure 10:
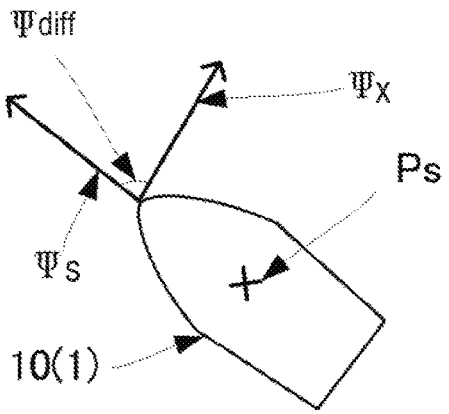
FIG. 10 shows views illustrating examples of a bearing control.
Figure 10:
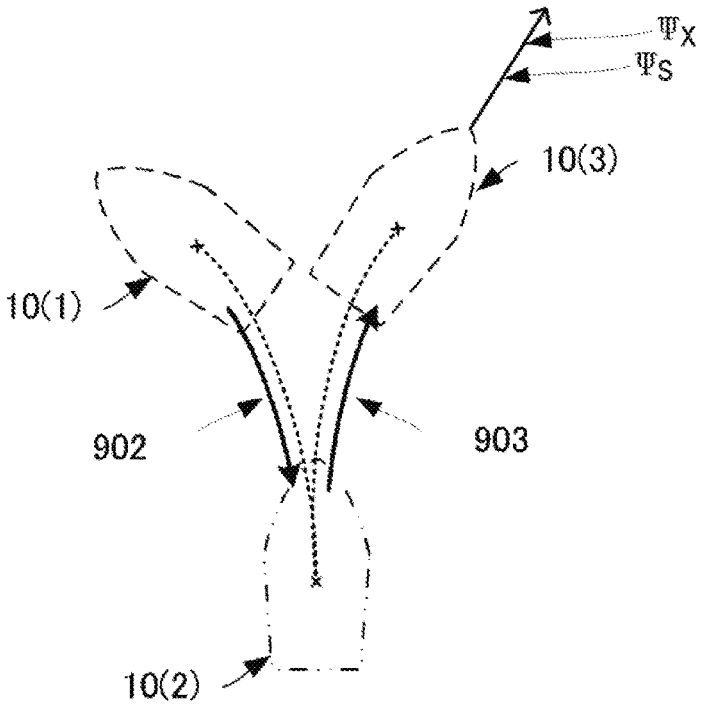

FIG. 10 shows views illustrating the concept of the bearing control. Part (A) of FIG. 10 is a view illustrating one example in which the heading Ψs is greatly different from the target bearing Ψx. Part (B) of FIG. 10 is a view illustrating the course of the ship 10 for adjusting the heading Ψs. In FIG. 10, a ship 10(*n*) indicates the ship 10 at a given position (n).

The ship 10 may change the heading Ψs by moving forward and backward at the current position Ps (turn on the spot). In FIG. 10, the heading Ts of the ship 10(1) is a bearing on the counterclockwise side of the target bearing Ψx. In other words, the deviation angle Ψdiff between the target bearing Ψx and the heading Ψs is a negative angle. When an absolute value of the negative deviation angle Ψdiff is larger than the given angle Ψth, the ship controller 24 may output the information of the thrust direction to turn the rudder 40 to the left, and the information of the power amount to move the ship 10(1) backward. In this manner, the ship 10 may move backward while causing the negative deviation angle Ψdiff to approach 0°, as in an adjusted course 902. As a result, the deviation angle Ψdiff may approach closer to 0° than that in the state of the ship 10(1). Further, the ship controller 24 may output the information of the thrust direction to turn the rudder 40 to the right, and the information of the power amount to move the ship 10(2) forward. In this manner, the ship 10(2) may move forward while causing the negative deviation angle Ψdiff to further approach 0° as in an adjusted course 903. As a result, the deviation angle Ψdiff may substantially be zero. In other words, the heading Ψs may match with the target bearing Ψx as indicated by the ship 10(3).

Note that, when the deviation angle Ψdiff is a positive angle and the absolute value of the deviation angle Ψdiff is equal to or larger than the given threshold, the ship controller 24 may output the information of the thrust direction to turn the rudder 40 to the right and the information of the power amount to move the ship 10 backward. Next, the ship controller 24 may output the information of the thrust direction to turn the rudder 40 to the left and the information of the power amount to move the ship 10 forward.

Moreover, in the example of Part (B) of FIG. 10, although the ship controller 24 may perform the control to move backward, it may perform a control to move forward.

As described above, when the deviation angle Ψdiff between the heading Ψs and the target bearing Ψx increases due to a change in the disturbance, the ship 10 may turn on the spot to prevent a large deviation from the course to the fixed point position Pp.

The ship controller 24 (fixed point setting module 241) may periodically execute the above S101 to S107 and perform the automatic navigation.

Figure 11:
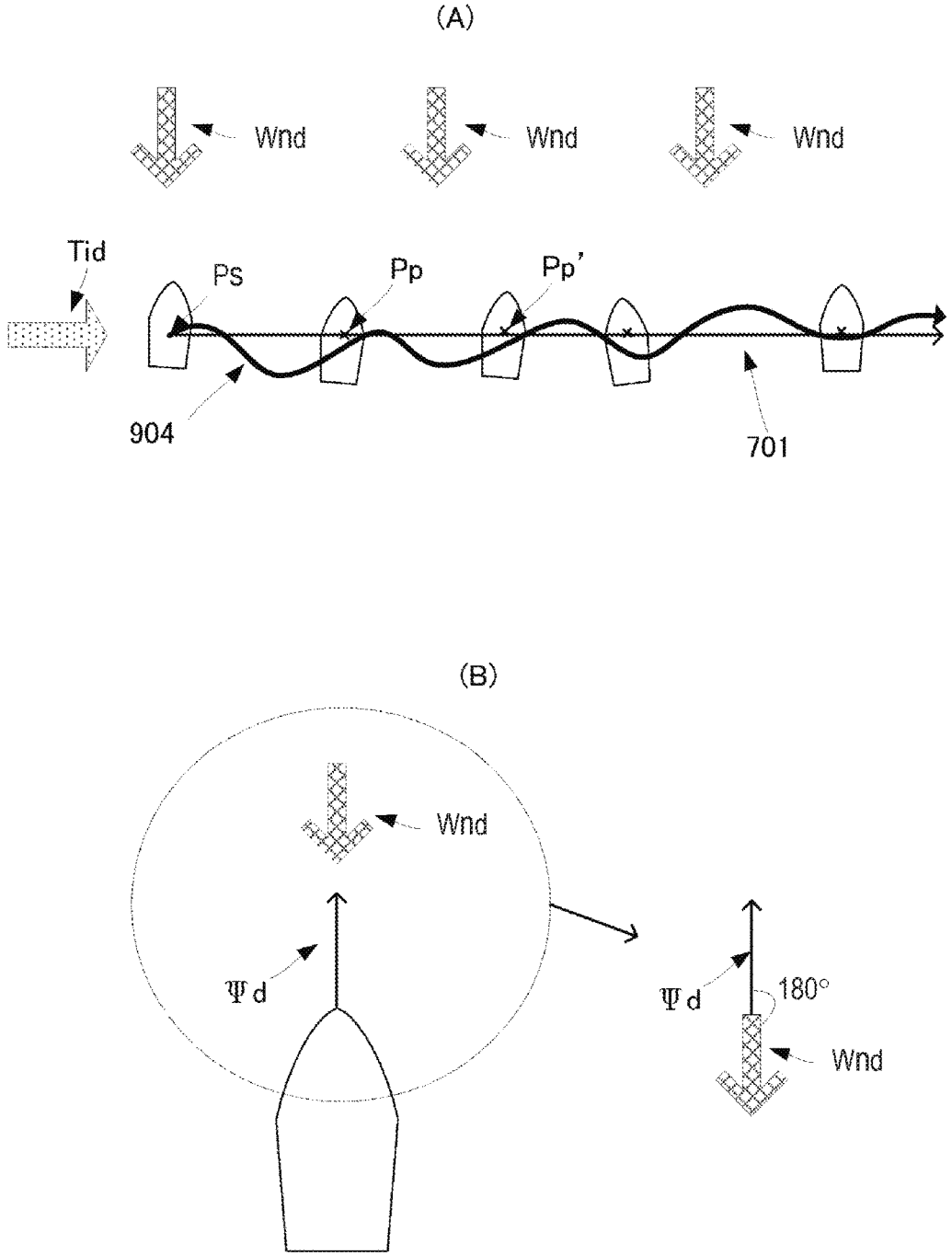
FIG. 11 shows views illustrating one example in which a heading is opposed to a direction of wind and is drifted by a tidal current.

Next, FIG. 11 shows views illustrating the concept of a movement control of the ship 10 according to a first application example.

In the above example, the bearing Ψd may be set to oppose to the disturbance bearing, whereas in the first application example, an example in which the bearing Ψd opposes to the wind direction and is drifted by a tidal current is given.

Part (A) of FIG. 11 is a view illustrating one example in which the bow is oriented to oppose to the wind direction and the ship 10 moves along the tidal current. In Part (A) of FIG. 11, a tidal current vector Tid may be a velocity vector indicating the velocity and bearing of the tidal current. A wind vector Wnd may be a velocity vector indicating the bearing and magnitude of the wind.

A fisherman may perform drift fishing in which the ship is moved along a tidal current so as to pass through a given location (e.g., a fish reef or a shallow) in order to find target fish. In the drift fishing, the fisherman may steer the ship so that the bow stands upwind so as to avoid the bow from shifting downwind.

Therefore, the ship controller 24 of the ship 10 of the first application example may set the bearing Ψd of the velocity vector Mov2 illustrated in FIG. 4 to oppose to the bearing of the wind vector Wnd. The bearing of the wind vector Wnd may be detected by the wind direction sensor of the sensor 23.

Further, as illustrated in Part (A) of FIG. 11, the fixed point setting module 241 may set a target straight line 701 passing through the current position Ps and parallel to the bearing of the tidal current vector Tid. Moreover, the fixed point setting module 241 may set on the target straight line 701 the fixed point position Pp having a given distance on the downstream side of the tidal current from the current position Ps. Note that the bearing of the tidal current vector Tid may be obtained by the tidal current meter provided to the sensor 23.

In this manner, the ship 10 may automatically navigate along the fixed point position Pp which is sequentially changed along the bearing of the tidal current vector Tid while orienting the heading Ψs to oppose to the bearing of the wind vector Wnd.

As described above, the ship 10 can perform the drift fishing even without providing a mechanism such as a spanker configured to orient the bow upwind, or a side thruster configured to cause a lateral movement.

Note that the ship 10 may set the bearing Ψd to be the bearing of the tidal current vector Tid and set the target straight line 701 to be parallel to the bearing of the wind vector Wnd.

Figure 12:
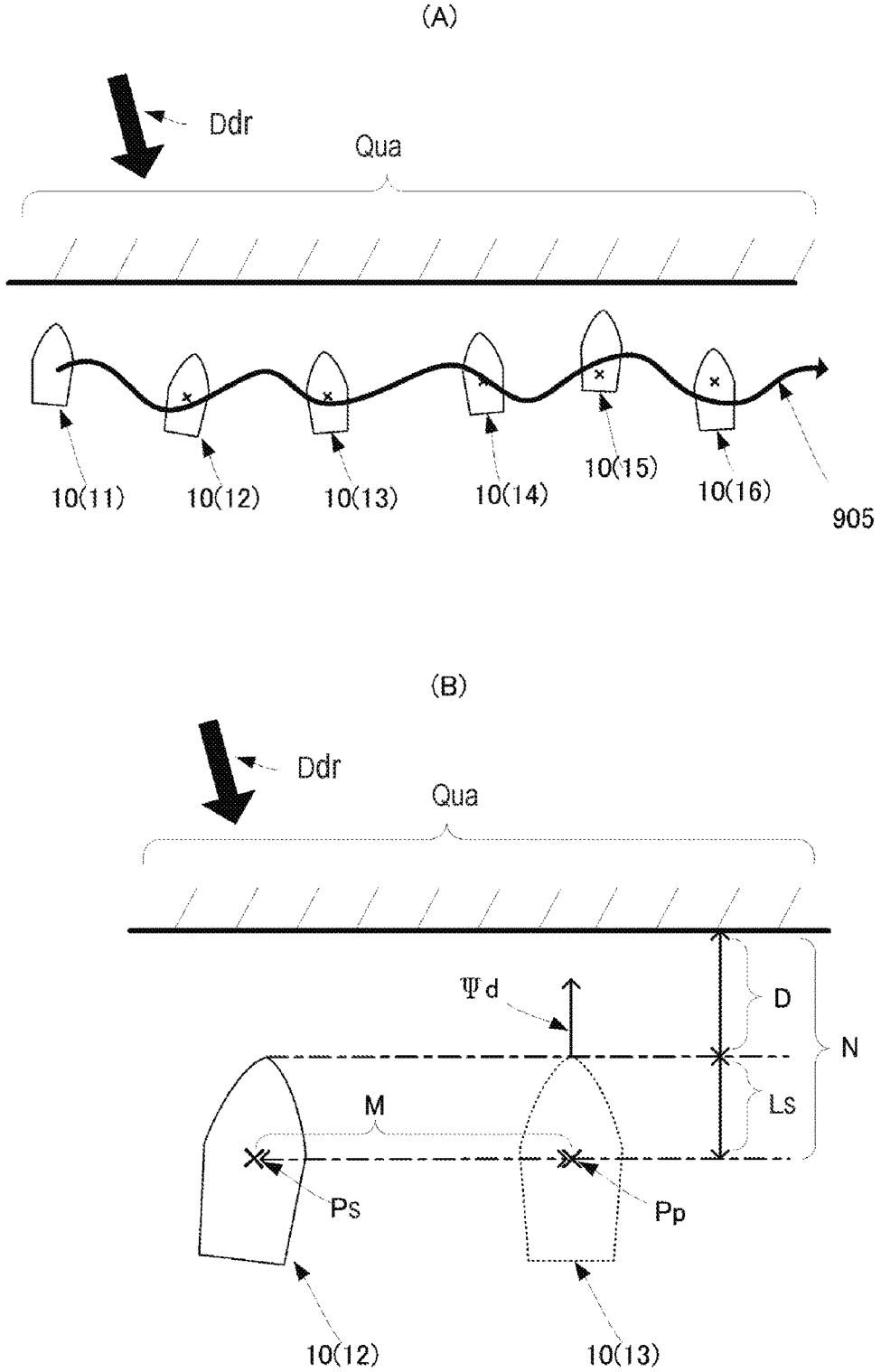
FIG. 12 shows views illustrating one example of a movement parallel to a quay.

Next, FIG. 12 shows views illustrating the concept of a movement control of the ship 10 according to a second application example.

Although in the above examples the bearing Ψd may be set to oppose to the wind direction or the tidal current direction or a combination thereof, it may be set to a different bearing.

Part (A) of FIG. 12 is a view illustrating one example of the automatic navigation of the ship 10 along a quay Qua.

Part (B) of FIG. 12 is a view illustrating settings of the fixed point position Pp and the bearing Ψd of the ship 10 according to the second application example.

The fisherman may steer the ship to move along the quay with the bow oriented toward the quay in order to find target fish.

Therefore, as illustrated in Part (B) of FIG. 12, the fixed point setting module 241 of the ship 10 of the second application example may set the fixed point position Pp based on a distance D from the bow of the ship 10 to the quay Qua.

For example, as illustrated in Part (B) of FIG. 12, the fixed point setting module 241 may set the length from the bow to the center of the ship as a length Ls, and set, as the fixed point position Pp, a point away from the quay Qua by a total distance N of the distance D and the length Ls and away from the current fixed point position Pp by a distance M along a bearing parallel to the quay. The distance D and the length Ls may be inputted to the user-interface 25 by the user, for example. Further, the user may input to the user-interface 25 the bearing Ψd to be orthogonal to the quay Qua. Then, the ship controller 24 may perform the movement control toward the fixed point position Pp.

As described above, the ship 10 can automatically navigate along the quay Qua by simply setting the fixed point position Pp and the bearing Ψd.

Moreover, during the automatic navigation, the ship controller 24 may also control the ship 10 to measure the distance D from the bow to the quay Qua by using a nautical chart stored in advance and one of a GPS and an ultrasonic sensor. In this case, when the distance D from the bow to the quay Qua becomes equal to or shorter than a given distance, the ship controller 24 may move forward or backward to move away from the quay Qua.

Figure 13:
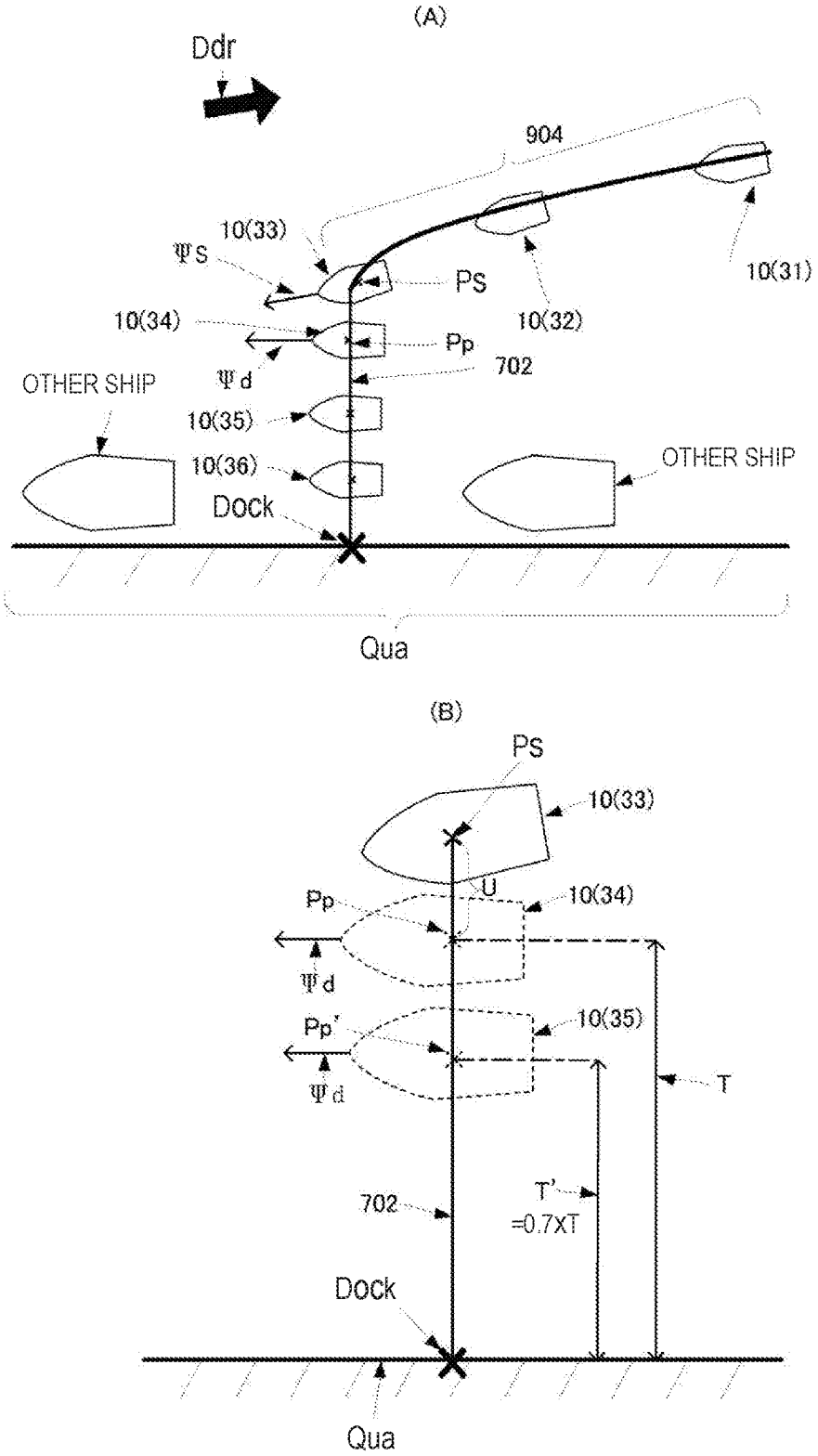
FIG. 13 shows views illustrating an example of coming alongside a quay, pier, wharf, dock, or any "arriving point".

Next, FIG. 13 shows views illustrating the concept of a movement control of the ship 10 according to a third application example.

Part (A) of FIG. 13 is a view illustrating one example in which the ship 10 coming alongside a docking location Dock of the quay Qua. Part (B) of FIG. 13 is a view illustrating settings of the fixed point position Pp and the target bearing Ψx of the ship 10 according to the third application example.

The ship 10 of the third application example may automatically navigate to gradually approach the quay while adjusting the heading Ψs to be parallel to the quay Qua.

First, when the user manually steers the ship to a position indicated by a ship 10(33) along a course 904 illustrated in Part (A) of FIG. 13, the user may input the docking location Dock to arrive at on the nautical chart, to the user-interface 25. Further, the user may input to the user-interface 25 the bearing Ψd to be parallel to the quay Qua.

As illustrated in Part (B) of FIG. 13, the fixed point setting module 241 may obtain the current position Ps by using the positioning unit 22. Further, the fixed point setting module 241 may set a target straight line 702 connecting the current position Ps with the docking location Dock.

Next, the fixed point setting module 241 may set the fixed point position Pp on the target straight line 702.

As illustrated in Part (B) of FIG. 13, the fixed point position Pp may be set on the target straight line 702 at a point separated from the docking location Dock by a given distance T.

Further, the ship controller 24 may output the control information to the power source 30 and the rudder controller 27 so as to move toward the fixed point position Pp.

When the current position Ps reaches at a given distance U from the fixed point position Pp, the fixed point setting module 241 may set a new fixed point position Pp'.

The new fixed point position Pp' may be set on the target straight line 702 at a point separated from the docking location Dock by a given distance T'. The distance T' may be 0.7 times the distance T, for example.

Note that, a distance U' which triggers the setting of the new fixed point position Pp' may also desirably be set to 0.7 times the distance U, for example.

In this manner, the velocity of the ship 10 may drop as approaching closer to the quay Qua.

As described above, the ship 10 may not cause the fixed point position Pp to rapidly approach the quay Qua. In other words, the ship 10 can gradually approach the quay Qua.

Further, by measuring the distance from the ship body to the quay Qua by the ultrasonic sensor of the sensor 23 during the automatic navigation to reach the docking location Dock, the ship 10 can further gradually approach the quay wall Qua.

Note that, in the above description, the example in which the ship is described as an example of a movable body is given; however, the configurations and processings described above are also applicable to movable bodies (amphibious vehicles, water bikes, etc.) having a thrust only in a specific direction and configured to move on or under water.

Moreover, in the above description, an example in which the respective functional units are hardware is given; however, the positioning unit 22, the ship controller 24, the power controller 26, and the rudder controller 27 are also achievable by software. In other words, the above processings are achievable by programming the processings of these functional units, storing them in a memory medium, and reading a ship control program to execute it by an arithmetic unit (computer etc.).

DESCRIPTION OF REFERENCE CHARACTERS

10 Ship
20 Ship Control Device
21 Antenna
22 Positioning Unit
23 Sensor
24 Ship Controller
25 User-interface
26 Power Controller
27 Rudder Controller
30 Power Source
31 Propeller
40 Rudder
240 Disturbance Bearing Estimating Module
241 Fixed Point Setting Module

What is claimed is:

1. A control device of a movable body including a thrust generator configured to thrust the movable body in a specific direction, and a moving direction adjustor configured to adjust a direction in which the movable body moves by the thrust, comprising:

a movable body direction sensor configured to detect an oriented direction of the movable body;

a position sensor configured to detect a position of the movable body; and processing circuitry configured to:

estimate a direction of a disturbance that moves the movable body;

set a fixed point position that is a position at which the movable body is to stay; and control the thrust generator and the moving direction adjustor so that:

the oriented direction of the movable body detected by the movable body direction sensor opposes to the direction of the disturbance estimated by the processing circuitry, and the movable body stays at the fixed point position set by the processing circuitry; wherein the processing circuitry is further configured to sequentially change the fixed point position when a distance between the position of the movable body detected by the position sensor and the fixed point position is shorter than a first given distance.

2. The control device of the movable body of claim 1, further comprising a velocity sensor configured to detect a velocity at which the movable body moves, wherein the processing circuitry changes the fixed point position when the velocity detected by the velocity sensor is lower than a given velocity.

3. The control device of the movable body of claim 1, wherein the processing circuitry changes the fixed point position every given period of time.

4. The control device of the movable body of claim 1, wherein the processing circuitry accepts an input of a target path along which the movable body is to move, and changes the fixed point position on the inputted target path.

5. The control device of the movable body of claim 1, wherein, the disturbance is a wind that moves the movable body, and the processing circuitry controls the thrust generator and the moving direction adjustor so that the oriented direction of the movable body detected by the movable body direction sensor opposes to a direction of the wind.

6. The control device of the movable body of claim 1, wherein, the disturbance is a tidal current that moves the movable body, and the processing circuitry controls the thrust generator and the moving direction adjustor so that the oriented direction of the movable body detected by the movable body direction sensor opposes to a direction of the tidal current.

7. The control device of the movable body of claim 1, wherein the processing circuitry accepts an input of a target object that is a target of the movement of the movable body, and controls the oriented direction of the movable body detected by the movable body direction sensor according to an orientation of the inputted target object.

8. The control device of the movable body of claim 7, wherein the processing circuitry controls the oriented direction of the movable body to be a direction in which the target object is located.

9. The control device of the movable body of claim 8, wherein the processing circuitry changes the fixed point position to be located in a direction orthogonal to the direction in which the target object is located, and to have a second given distance from the target object.

10. The control device of the movable body of claim 7, wherein the processing circuitry controls the oriented direction of the movable body to be orthogonal to a direction in which the target object is located.

11. The control device of the movable body of claim 10, wherein the processing circuitry changes the fixed point position to be located in the direction in which the target object is located, and to have a third given distance from the target object.

12. The control device of the movable body of claim 1, wherein when a deviation angle between the oriented direction of the movable body detected by the movable body direction sensor and the direction of the disturbance estimated by the processing circuitry becomes equal to or larger than a given angle, the processing circuitry only controls the oriented direction of the movable body to oppose to the direction of the disturbance.

13. A method of controlling a movable body including a thrust generator configured to thrust the movable body in a specific direction, and a moving direction adjustor configured to adjust a direction in which the movable body moves by the thrust, comprising:

estimating a direction of a disturbance that moves the movable body;

detecting an oriented direction of the movable body;

detecting a position of the movable body;

setting a fixed point position that is a position at which the movable body is to stay;

controlling the thrust generator and the moving direction adjustor so that the oriented direction of the movable body detected by the detecting the movable body direction opposes to the direction of the disturbance estimated by the estimating the disturbance direction, and so that the movable body stays at the fixed point position set by the setting the position; and sequentially changing the fixed point position when a distance between the position of the movable body and the fixed point position is shorter than a first given distance.

14. A program for controlling a movable body executed by a control device of the movable body with a thrust generator configured to thrust the movable body in a specific direction, and a moving direction adjustor configured to adjust a direction in which the movable body moves by the thrust, comprising:

estimating a direction of a disturbance that moves the movable body;

detecting an oriented direction of the movable body;

detecting a position of the movable body;

setting a fixed point position that is a position at which the movable body is to stay;

controlling the thrust generator and the moving direction adjustor so that the oriented direction of the movable body detected by the detecting the movable body direction opposes to the direction of the disturbance estimated by the estimating the disturbance direction, and so that the movable body stays at the fixed point position set by the setting the position; and sequentially changing the fixed point position when a distance between the position of the movable body and the fixed point position is shorter than a first given distance.

15. The control device of the movable body of claim 1, wherein, the disturbance is a wind that moves the movable body, and the processing circuitry controls the thrust generator and the moving direction adjustor so that the oriented direction of the movable body detected by the movable body direction sensor opposes to a direction of the wind.

16. The control device of the movable body of claim 1, wherein, the disturbance is a tidal current that moves the movable body, and the processing circuitry controls the thrust generator and the moving direction adjustor so that the oriented direction of the movable body detected by the movable body direction sensor opposes to a direction of the tidal current.

17. The control device of the movable body of claim 2, wherein, the disturbance is a wind that moves the movable body, and the processing circuitry controls the thrust generator and the moving direction adjustor so that the oriented direction of the movable body detected by the movable body direction sensor opposes to a direction of the wind.

18. The control device of the movable body of claim 2, wherein, the disturbance is a tidal current that moves the movable body, and the processing circuitry controls the thrust generator and the moving direction adjustor so that the oriented direction of the movable body detected by the movable body direction sensor opposes to a direction of the tidal current.

19. The control device of the movable body of claim 1, wherein when a deviation angle between the oriented direction of the movable body detected by the movable body direction sensor and the direction of the disturbance estimated by the processing circuitry becomes equal to or larger than a given angle, the processing circuitry only controls the oriented direction of the movable body to oppose to the direction of the disturbance.

* * * * *